US006981384B2

(12) United States Patent
Dobmeier et al.

(10) Patent No.: US 6,981,384 B2
(45) Date of Patent: Jan. 3, 2006

(54) MONITORING REFRIGERANT CHARGE

(75) Inventors: Thomas J. Dobmeier, Phoenix, NY (US); Michael F. Taras, Fayetteville, NY (US); Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/805,785

(22) Filed: Mar. 22, 2004

(65) Prior Publication Data

US 2005/0204756 A1 Sep. 22, 2005

(51) Int. Cl.
*F25B 45/00* (2006.01)

(52) U.S. Cl. ..... 62/149; 62/77

(58) Field of Classification Search ..... 62/149, 62/77, 176.6, 156, 159, 292
See application file for complete search history.

(56) References Cited

U.S. PATENT DOCUMENTS 4,136,528 A * 1/1979 Vogel et al. ..... 62/174
4,193,781 A * 3/1980 Vogel et al. ..... 62/81
4,876,859 A 10/1989 Kitamoto
5,802,860 A * 9/1998 Barrows ..... 62/126
5,875,637 A 3/1999 Paetow
6,047,556 A 4/2000 Lifson
6,109,047 A * 8/2000 Cowans et al. ..... 62/199
6,161,394 A * 12/2000 Alsenz ..... 62/184
6,206,652 B1 3/2001 Caillat
6,499,535 B2 * 12/2002 Cowans ..... 165/206

OTHER PUBLICATIONS

Systems & Advanced Technologies Engineering S.r.I. publication entitled "Compsys-Dynamic Simulation of Gas Compression Plants".
Copeland Application Guide for "Refrigeration Scroll For Parallel Applications".

* cited by examiner

*Primary Examiner*—Melvin Jones
(74) *Attorney, Agent, or Firm*—Carlson, Gaskey & Olds

(57) ABSTRACT

An air conditioning, heating or refrigeration system includes a controller that automatically determines if refrigerant amount is above or below the desired amount within the system. In one example, a sensor measures the temperature difference between sub-cooled liquid and saturated condensing temperature and provides information to the controller. The controller determines a variance between the measured and an expected value. If that variance exceeds a selected threshold, the controller automatically determines that the amount of refrigerant in the system is outside of an acceptable range.

20 Claims, 1 Drawing Sheet

MONITORING REFRIGERANT CHARGE

FIELD OF THE INVENTION

This invention generally relates to refrigerant systems. More particularly, this invention relates to monitoring an amount of refrigerant charge within an air conditioning or refrigeration system.

DESCRIPTION OF THE RELATED ART

Air conditioning and refrigeration systems typically utilize a refrigerant to achieve a desired amount of cooling within a building, for example. Having an adequate amount of refrigerant within the system is necessary to achieve a desired system operation and to prevent malfunctions or damage to the system components. Many systems are charged at a factory. Others are charged by a technician after installation in the field.

It is possible for the refrigerant charge in the system to be initially too low or for some refrigerant to be lost or reduced during operation to a level that hinders the ability of the system to provide adequate cooling. At some levels, a loss of refrigerant charge may cause damage to the system components such as the compressor. Typical causes of inadequate refrigerant amounts include inadequate charge at the factory or during installation in the field or leakage through damaged components or loose connections.

It is necessary to detect a loss of refrigerant charge as early as possible to avoid interrupting system operation, especially during high ambient temperature conditions. It is also prudent and critical to diagnose any loss-of-charge failure modes as early as possible to avoid system component damage. While proposals have been made for detecting a loss of refrigerant charge, known arrangements do not provide an early enough indication or are not reliable enough because they can be mistaken for some other system malfunction such as an evaporator air flow blockage, compressor damage or a plugged distributor. Using known techniques and trying to differentiate between such failure modes requires exhaustive and expensive troubleshooting.

Similarly, overcharge conditions need to be detected, since it prevents nuisance shutdowns and reduces life-cycle operating cost for the end user.

This invention provides a unique way of monitoring the amount of refrigerant charge within an air-conditioning system that decreases the likelihood of an interruption in the desired system performance that would otherwise be caused by a refrigerant charge loss.

SUMMARY OF THE INVENTION

An embodiment of this invention includes using at least one measurement of a temperature difference between a temperature of liquid upstream and near an expansion device, and a saturated temperature of refrigerant in the condenser.

One example method includes automatically determining the temperature difference and then determining a variance between the determined temperature difference and an expected temperature difference to provide information regarding an amount of refrigerant in the system.

In one example, a system controller provides an indication of an undesirable amount of refrigerant when the determined variance exceeds the selected threshold.

An example refrigerant system designed according to this invention includes an electric motor driven compressor, and a condenser located downstream of the compressor. An evaporator is located upstream of the compressor. An expansion device is positioned between the condenser and the evaporator. The refrigerant between the condenser and the expansion device is typically in a liquid state. A controller determines if an amount of refrigerant in the system differs from a desired amount by determining a temperature difference between liquid downstream of the condenser and upstream of the expansion device on the one hand, and a saturated refrigerant temperature in the condenser on the other hand. The controller determines a variance between that determined temperature difference and an expected temperature difference corresponding to the desired amount of refrigerant.

The various features and advantages of this invention will become apparent to those skilled in the art from the following description of the currently preferred embodiments. The drawings that accompany the detailed description can be described as follows.

DETAILED DESCRIPTION OF THE PREFERRED EMBODIMENT

Figure 1:
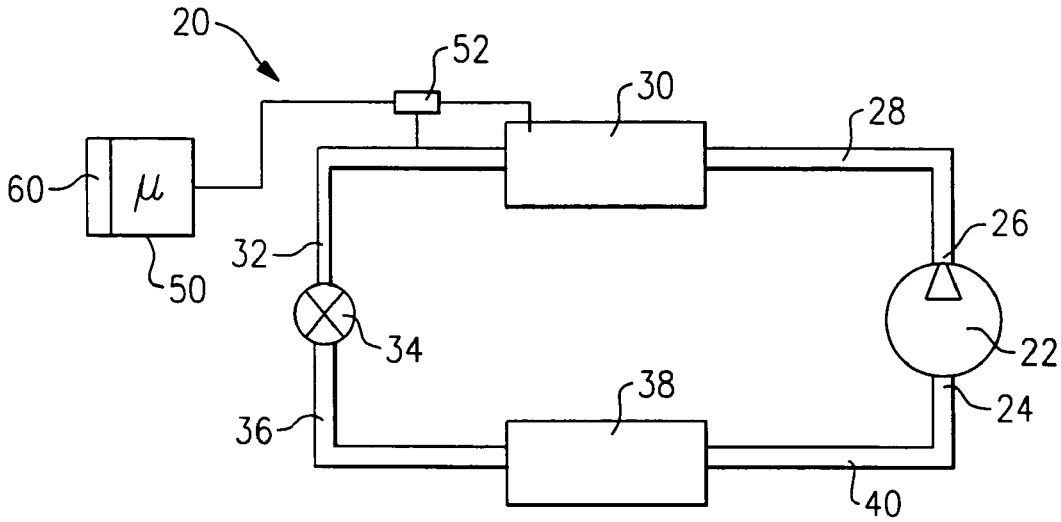
FIG. 1 schematically illustrates a refrigerant system designed according to an embodiment of this invention.

FIG. 1 schematically shows a refrigerant system 20 that may be used as an air conditioning system, heat pump or a refrigeration system. A compressor 22 draws refrigerant from a suction port 24 and provides a compressed gas under pressure to a compressor discharge port 26. The high temperature, pressurized gas flows through a conduit 28 to a condenser 30 where the gas dissipates heat and condenses into a liquid as known. The liquid refrigerant flows through a conduit 32 to an expansion device 34. As the refrigerant in the conduit 32 typically is in a liquid state, the conduit 32 is sometimes referred to as the liquid line.

In one example, the expansion device 34 operates in a known manner to allow the liquid refrigerant to be expanded and to partially evaporate and flow into a conduit 36 in the form of a cold, low pressure refrigerant. This refrigerant then flows through an evaporator 38 where the refrigerant absorbs heat from air that flows across the evaporator coils, which provides cooled air to the conditioned space as known. The refrigerant exiting the evaporator 38 flows through a conduit 40 to the suction port 24 of the compressor 22 where the cycle continues.

The example of FIG. 1 includes a controller 50 that monitors selected characteristics of the system to automatically determine an amount of refrigerant within the system. In this example, the controller 50 communicates with a temperature difference sensor 52 that can be a stand alone temperature difference sensor or it can be a combination of several sensors whose purpose would be to detect a temperature difference between liquid downstream of the condenser and upstream of the expansion device on the one hand and a saturation refrigerant temperature in the condenser on the other hand.

For example, if a differential sensor consists of two sensors, then one temperature sensor can be located inside the condenser 54. Preferably, such a temperature sensor is located toward the mid-portion of the condenser such that it will sense temperature that corresponds to a saturated refrigerant. The other sensor then can be located in the liquid line 32.

The controller 50 uses the sensed temperatures to calculate the temperature difference to make a determination whether the amount of refrigerant within the system is at a desired level. If the temperature difference is determined by a single sensor than no additional calculations by a controller are required and this value is entered directly into the controller. The controller then uses predetermined expected or desired temperature difference values to determine whether the level of refrigerant within the system is acceptable. In one example, a variance between the determined temperature difference and the expected temperature difference provides an indication of the amount of refrigerant relative to a desired amount.

In one example, the controller 50 preferably determines the temperature difference while the system 20 is operating to provide cooling or heating.

If even more precise determination of adequate refrigerant charge is desired, then further additional system operational parameters and characteristics, such as low side (e.g., suction) pressure, outdoor temperature, indoor dry-bulb temperature, indoor wet-bulb temperature, compressor volume, condenser volume, evaporator volume, amount of oil in the compressor and electric motor size and efficiency may need to be measured or considered. Even more parameters can be included for redundancy. In one example, a charging chart will be represented by an additional family of relationship curves.

Figure 2:
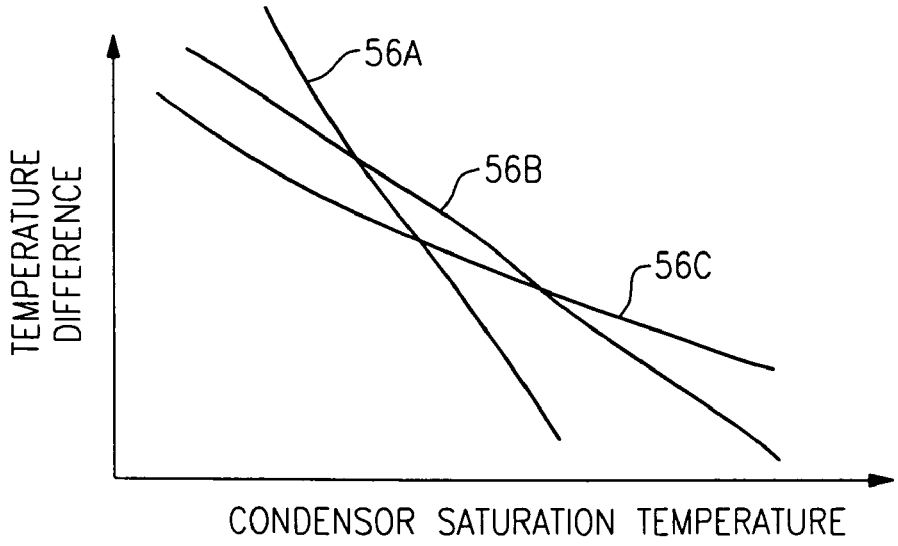
FIG. 2 is a graphical illustration of an example relationship between a temperature difference and saturation condensing temperature for various system compressor volumes.

FIG. 2 shows example plots 56 of a relationship between the temperature difference and saturation condensing temperature for different compressor volumes. The temperature difference of FIG. 2 is the temperature difference between liquid downstream of the condenser and upstream of the expansion device on the one hand and a saturation refrigerant temperature in the condenser on the other hand. The plot 56A is for a first example volume, the plot 56*b* is for a second, higher example volume and the plot 56*c* is for a third, higher example volume. These plots represent examples of a desired relationship for a selected refrigerant. In this example, the controller 50 determines whether the determined temperature difference and saturation condensing temperature are within a selected tolerance band for a given compressor volume. If the determined relationship differs from the expected relationship for a given volume, the controller determines that there is an undesirable amount of refrigerant in the system.

In the illustrated example, if the determined value of the temperature difference for a determined value of saturation condensing temperature and compressor volume is above the appropriate curve 56, that indicates that there is an inadequate amount of refrigerant in the system and refrigerant should be added. In the illustrated example, if the determined value of the temperature difference is below the appropriate curve 56 and outside of the selected tolerance band, that indicates that too much charge is in the system and that some refrigerant could or should be removed. In one example, a 5% variation from the curve 56 is within an acceptable tolerance.

Given this description, those skilled in the art will be able to determine the expected temperature difference relationships for a variety of refrigerants and particular system configurations to meet the needs of their particular situation. The controller 50 may be preprogrammed with a single expected relationship for a particular system or may be preprogrammed with a series of expected relationships, depending on the needs of a particular situation. Those skilled in the art who have the benefit of this description will also be able to select an appropriate tolerance band.

In the example of FIG. 1, the controller 50 has an interface 60 associated with it. The interface 60 allows for providing an indication of an undesirable amount of refrigerant within the system. In one example, the interface 60 includes a display that provides a visual indication of the determination made by the controller regarding the refrigerant amount in the system. In another example, the interface 60 provides an audible alarm in the event that the refrigerant amount falls outside of an acceptable range.

In one example, the controller 50 automatically shuts down the system 20 in the event that the refrigerant amount falls outside of a selected range based on the determined variation from the expected temperature and pressure relationship.

In one example, for properly determining acceptable charge, the controller is provided with information regarding the estimate of compressor volume and amount of oil in the compressor. This information is important in determining the proper refrigerant charge amount in case of an electrically driven compressor such as typical scroll or reciprocating compressors. In these type of systems, the compressor volume often occupies a significant portion of the system volume and the amount of the appropriate refrigerant charge would depend on the compressor volume. The amount of oil present in the oil sump of the compressor can also occupy a substantial volume. As such, the amount of liquid refrigerant absorbed by oil would vary substantially from one operating condition to another and thus affect the appropriate amount of refrigerant charge that is needed.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of monitoring an amount of refrigerant in a refrigerant system having an electric motor driven compressor, a condenser and an evaporator;

determining a temperature difference between a saturation condensing temperature and a liquid refrigerant temperature of sub-cooled refrigerant; and automatically determining a variance between the determined temperature difference and a desired temperature difference, and utilizing said variance to determine whether the amount of refrigerant in the refrigerant system is as desired.

2. The method of claim 1, including determining whether the variance exceeds a selected threshold.

3. The method of claim 2, including providing an indication of an undesirable amount of refrigerant in the system when the determined difference exceeds the selected threshold.

4. The method of claim 1, including determining the temperature difference when the system is operating to provide cooling.

5. A method of monitoring an amount of refrigerant in a refrigerant system having an electric motor driven compressor, a condenser and an evaporator;

determining a temperature difference between a saturation condensing temperature and a liquid refrigerant temperature of sub-cooled refrigerant; and automatically determining a variance between the determined temperature difference and a desired temperature difference, including determining the temperature difference when the system is operating to provide heating.

6. The method of claim 1, including determining whether the amount of refrigerant in the system is above or below a desired level.

7. A refrigerant system, comprising:

at least one sensor that provides an indication of a temperature difference between a saturation condensing temperature and a liquid refrigerant temperature of sub-cooled refrigerant; and a controller that uses the temperature difference to determine if the amount of refrigerant within the refrigerant system is different from a desired amount.

8. The system of claim 7, wherein the controller determines a difference variance between the indicated temperature difference and an expected temperature difference and uses the determined variance to determine whether the amount of refrigerant in the system is different than the desired amount.

9. The system of claim 8, wherein the controller determines whether the variance exceeds a selected threshold.

10. A refrigerant system comprising:

at least one sensor that provides an indication of a temperature difference between a saturation condensing temperature and a liquid refrigerant temperature of sub-cooled refrigerant; and a controller that uses the temperature difference to determine if the amount of refrigerant is different from a desired amount, wherein the controller also uses at least one of a compressor free volume on a suction side, a compressor free volume on a discharge side, an oil amount in the compressor, a low side pressure, an outdoor temperature, an indoor dry bulb temperature, an indoor wet bulb temperature, a vapor saturated temperature, an amount of superheat at a compressor suction line, an electric motor size, an electric motor efficiency or a line voltage as a further indicator of the amount of refrigerant.

11. The system of claim 7, including a compressor, a condenser downstream of the compressor and an evaporator upstream of the compressor.

12. The system of claim 7, wherein the controller provides an indication when the amount of refrigerant in the system is outside of an acceptable range.

13. The system of claim 7, wherein the refrigerant system operates in a cooling mode.

14. The system of claim 7, wherein the refrigerant system operates in a heating mode.

15. The method of claim 1, wherein a warning signal is produced if the determination is made that the amount of refrigerant within the system is not as desired.

16. The method of claim 15, wherein said warning signal is visual.

17. The method of claim 15, wherein said warning signal is audio.

18. The system of claim 7, wherein a warning signal is produced if a determination is made that the amount of refrigerant within the system is different from the desired amount.

19. The system of claim 18, wherein said warning signal is visual.

20. The system of claim 18, wherein said warning signal is audio.

* * * * *